United States Patent [19]

Steeves et al.

[11] Patent Number: 4,481,043

[45] Date of Patent: Nov. 6, 1984

[54] HEAT TREATMENT OF NICRFE ALLOY TO OPTIMIZE RESISTANCE TO INTERGRANNULAR STRESS CORROSION

[75] Inventors: Arthur F. Steeves, Schenectady; Albert E. Bibb, Clifton Park, both of N.Y.

[73] Assignee: The United States of America as represented by the United States Department of Energy, Washington, D.C.

[21] Appl. No.: 447,727

[22] Filed: Dec. 7, 1982

[51] Int. Cl.[3] ..... C22F 1/16

[52] U.S. Cl. ..... 148/20.3; 148/162; 148/410

[58] Field of Search ..... 148/162, 12.7 N, 20.3, 148/410; 420/448

[56] References Cited

U.S. PATENT DOCUMENTS

| | | | |
|---|---|---|---|
| 3,434,891 | 3/1969 | Wenderott | 148/13 |
| 3,573,901 | 4/1971 | Economy | 420/448 |
| 3,645,726 | 2/1972 | Copson et al. | 148/13 |
| 3,772,090 | 11/1973 | Allen et al. | 148/13 |
| 3,898,109 | 8/1975 | Shaw | 148/162 |

*Primary Examiner*—R. Dean

*Attorney, Agent, or Firm*—Michael F. Esposito

[57] ABSTRACT

A process of producing a NiCrFe alloy having a high resistance to stress corrosion cracking comprising heating a NiCrFe alloy to a temperature sufficient to enable the carbon present in the alloy body in the form of carbide deposits to enter into solution, rapidly cool the alloy body, and heat the cooled body to a temperature between 1100° to 1500° F. for about 1 to 30 hours.

15 Claims, No Drawings

HEAT TREATMENT OF NICRFE ALLOY TO OPTIMIZE RESISTANCE TO INTERGRANNULAR STRESS CORROSION

The United States has rights to this invention pursuant to Contract No. DE-AC12-76 SN00052 between the Department of Energy and General Electric Corporation.

BACKGROUND OF THE INVENTION

The present invention is directed to a method of producing nickel alloys having improved resistance to stress corrosion cracking. In particular, the present invention is directed to a method of fabricating NiCrFe alloys which exhibited excellent resistance to stress corrosion cracking in deaerated primary water (i.e., low oxygen content water used in nuclear reactors).

The problem of stress corrosion in deaerated primary water has existed for some time. Accordingly, the literature is replete with various approaches which attempt to solve this problem.

Initially, researches in this area looked at the wealth of literature accumulated over the years in coping with stress corrosion cracking of austenitic nickel-chromium stainless steels in chloride environments. However, this avenue of exploration was not successful because stress corrosion cracking of the stainless steels in chloride solution is primarily transgranular in nature whereas NiCrFe stress corrosion in deaerated water is intergranular.

Another approach to the stress corrosion cracking problem centered on the use of materials of very high purity, i.e., the use of extremely pure nickel, chromium and iron and not much else. This pursuit appeals more to theoretical curiosity since it is basically impractical from a commercial viewpoint. Not only is it expensive to use such materials but good commercial practice requires the use of various other elements to provide necessary deoxidizing and malleabilizing attributes and to provide, for example, good forging practice. Moreover, it is not unlikely that the mechanical properties of such alloys would be inferior.

Although the above discussed approaches did not solve the problem of SCC in NiCrFe alloy, they did serve to focus greater attention on appreciating the significance of the operating environmental conditions which could lead to the type of corrosive attack in question and, also, understanding the ostensible peculiarities or behavior of nickel-chromium-iron alloys upon exposure to such conditions. Perhaps it should be mentioned that high purity water as contemplated herein contains a total solids content of less than one part per million (p.p.m.) by weight and has been distilled and/or deionized or otherwise treated such that it will manifest a specific resistance of about 500,000 ohm-cm or higher.

Certain environmental conditions have been established which either promote or are causative of inducing or creating a propensity for detrimental intergranular stress-corrosion cracking to occur in nickel-chromium-iron alloys. Aerated high-purity water (in combination with the surface condition of the alloys) is one such condition and temperature is another. Normally, high-purity water is devoid of oxygen, and it is believed that the usual absence thereof, has been responsible, to a considerable degree, for the lack of intergranular stress-corrosion cracking of nickel-chromium-iron alloys. But the possibilities of oxygen contamination are indeed more than sufficient to warrant the necessity of finding alloys which afford a markedly higher degree of resistance to such attack. As to temperature, if the temperature of the water is at about room temperature, stress-corrosion attack does not appear to be much of a problem. But, in commercial operation the temperature of the high-purity water is normally above room temperature and is commonly over 300° F. e.g., about 450° or 500° F., to about 660° F. and it is at such temperatures, particularly at the higher temperatures, where the occurrence of intergranular stress-corrosion attack is most likely.

U.S. Pat. No. 3,645,726 to Copson et al, proposed a solution to the SCC problem by limiting the composition of the NiCrFe alloy. While this solution has been successful to some degree it too is lacking for two reasons. First, while the proposed NiCrFe alloys are somewhat more resistant to SCC they are still subject to a high degree of uncertainty. That is, the incidence of SCC with these alloys is still unacceptably high. Accordingly, even these alloys must be subjected to severe testing procedures (i.e., evaluation) prior to installation in nuclear reactor facilities. (See U.S. Pat. No. 4,300,890 to Steeves et al relating to SCC evaluation techniques). Secondly, the composition limits on the NiCrFe alloy severely limit one's choices with regard to materials. The present invention is directed to a process of producing NiCrFe alloy processing the required SCC resistance properties needed for use in a nuclear facility environment. To this end it has been observed, during evaluation procedures (See U.S. Pat. No. 4,300,890), that NiCrFe alloys which do possess adequate resistance to SCC have carbide precipitated primarily in their grain boundaries. Accordingly, applicants' invention is directed to a method of producing NiCrFe possessing the required carbide grain boundary precipitation.

SUMMARY OF THE INVENTION

It is the primary object of the present invention to provide of method of producing NiCrFe alloys having high resistance to SCC in deaerated primary water.

It is another object of the present invention to provide a method of producing NiCrFe alloys having carbide deposits in an optimum range within the grain boundaries of the alloys.

It is still another object of the present invention to provide a method of producing NiCrFe alloys having raised grain boundaries subsequent to etching.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the process of the present invention comprises heating a finished NiCrFe alloy body to a temperature sufficient to, and for a time sufficient to, enable the carbon present in the alloy body in the form of carbide deposit to enter into solution, rapidly cooling the alloy to room temperature avoiding the precipitation of significant amounts of carbides, heating the cooled alloy between the temperature range of 1100° to 1500° F. for about 1 hour to 30 hours to maximize the amount of grain boundary relief (i.e., carbide deposit within the grain boundary) in the resulting alloy.

In a preferred embodiment of the process of present invention, the heating to soluabilize the carbon is performed in a nonoxidizing atmosphere at a temperature between about 1800° to 2100° F.

In a further preferred embodiment of the process of the present invention, the heating of the cooled alloy body is performed in a nonoxidizing or neutral atmosphere.

In a still further preferred embodiment of the process of the present invention, the heated NiCrFe alloy body is subjected to the second heating procedure to maximize the amount of grain boundary relief without being cooled to room temperature.

In a further aspect of the present invention, in accordance with its objects and purposes, the process of the present invention may also comprise heating a finished NiCrFe alloy body to a temperature sufficient to enable the carbon present in said alloy in the form of carbide deposits to enter into solution in said body, rapidly cooling the alloy body to room temperature substantially avoiding the precipitation of significant amounts of carbide, and heating the cooled alloy between the temperature range of about 1100° to 1500° F. for about 1 to 30 hours to maximize the amount of carbide deposited within the grain boundaries of the alloy. The resulting alloy has increased resistance to stress corrosion cracking.

In a preferred embodiment of this aspect of the present invention the heating to soluabilize the carbon is performed in a nonoxidizing atmosphere at a temperature of between about 1800° F. to 2100° F.

In a further preferred embodiment of this aspect of the present invention the heated alloy body is subjected directly to the second heat treatment procedure to maximize the amount of carbide deposited within the grain boundary.

In a still further preferred embodiment of this aspect of the present invention, the heating of the cooled alloy body is performed in a neutral or non-oxidizing atmosphere.

The process of the present invention is directed to the discovery that there is a specific heat treatment procedure for finished NiCrF alloys which will result in NiCrFc alloy having a high reliability of possessing good resistance to SCC. The results of applicants process indicate that treatment outside the upper temperature of their claimed range results in microscopic carbide formation at the grain boundaries which excessively broadens the carbide formation producing undesirable results. Treatment at temperatures below the claimed range does not enable sufficient carbide precipitation to take place at the grain boundaries producing resulting articles which unpredictably may, or may not, have good resistance to SCC.

Reference will now be made, in detail, to the preferred embodiments of the process of the present invention.

DETAILED DESCRIPTION OF THE PRESENT INVENTION

In general, the process of the present invention comprising heating a finished NiCrFe alloy body to a temperature sufficient to enable the carbon present in the alloy in the form of carbides to enter into solution, rapidly cooling the alloy to room temperature substantially avoiding precipitation of significant amounts of carbides, and heating the cooled alloy between the temperature range of 1100° to 1500° F. for about 30 to 1 hours to maximize the amount of grain boundary relief (i.e., carbide deposited within the grain boundary) for the resulting alloy.

Preferably, the heat treatment to soluabilize the carbon present in the NiCrFe alloy is between a temperature of about 1800° to 2100° F. The alloy should be maintained within this temperature range for about 1 hour/inch of the thickness of the alloy body to insure soluabilization of the carbon in the alloy body. In addition, the heating should take place in a nonoxidizing atmosphere to avoid decarbonization of the alloy surface, although this is not required if the alloy surface is subsequently removed. In addition, applicants' have discovered that solutionizing is a critical requirement to subsequent heat treatment and there is a generally linear relationship between the temperature required for solutionizing and the carbon content of the alloy. That is, alloy bodies having 0.03 wt percent carbon must be solutionized at a minimum of 1800° F., and the temperature required for solutionizing alloy bodies having >0.03 wt percent carbon increases until a temperature of 2100° F. is needed for alloys having about 0.09 wt percent carbon.

Rapid cooling from the solutionizing temperature to room temperature to avoid precipitation of significant amounts of carbide is preferably performed by water quenching. However, the alloy may be placed directly into the heat treatment furnace without cooling if desired.

The heat treatment to maximize the amount of grain boundary relief and, therefore, optimize the state of stress at the grain boundaries producing a NiCrFe alloy having excellent SCC resistance is usually performed in a neutral or nonoxidizing atmosphere (e.g., A, $H_2$). The resulting NiCrFe alloy is air cooled to room temperature after heat treatment. Applicants have discovered that neither the heating rate nor the cooling rate during this treatment is critical to the process of the present invention. However, it is known that the higher the temperature used for heat treatment, the shorter the amount of time required to complete the process (e.g., 1200° F. for 10–30 hours; 1500° F. for 1 to 3 hours).

To illustrate the method of the present invention the following examples are set forth below.

EXAMPLE I

A NiCrFe alloy, designated Alloy 600 having the following composition and in plate form was solution heat treated at 1900° F. for 20 minutes.

| Alloy 600 (0.75 plate) | |
|---|---|
| C | 0.029 |
| Mn | 0.28 |
| S | 0.003 |
| Si | 0.27 |
| Cr | 14.66 |
| Ni | 76.66 |
| Cu | 0.01 |
| Fe | 7.28 |
| Al | 0.18 |
| Co | 0.01 |
| Ti | 0.21 |

Following solution treatment to dissolve the carbides, samples of the treated alloy were heat treated according to the following conditions:

| Temperature, °F./Time, Hours |
|---|
| 900°/20 |
| 1000°/20 |
| 1100°/20 |
| 1200°/20 |
| 1300°/20 |
| 1400°/20 |
| 1500°/20 |
| 1600°/20 |

The samples were then cooled to room temperature and subjected to standard micrographic evaluation techniques to determine the SCC resistance of the alloys. For a teaching of conventional micrographic evaluation techniques for NiCrFe alloys see U.S. Pat. No. 4,305,779 to Steeves et al herein corporated by reference. In addition, the results of profilometer measurements after etching these specimens are set forth in Table I, below. A profilometer measures the difference in height and width of surface features by recording the variation in height of a diamond stylus as it traverses the specimen surface.

TABLE I

| Heat Treatment[1] Temperature, °F. Alloy 600 Plate | Etchant | PROFILOMETER RESULTS Height A* | Std. Dev. Å (Height) | Width μ* | Nominal Cross Sectional Area $\mu^2 \times 10^{-2}$ |
|---|---|---|---|---|---|
| 1100 | Nital | 309 | 87 | 0.45 | 1.39 |
| | Phosphoric | 172 | 70 | 0.50 | 0.86 |
| 1200 | Nital | 555 | 175 | 1.01 | 5.60 |
| | Phosphoric | 530 | 207 | 0.57 | 3.02 |
| 1300 | Nital | 562 | 100 | 1.70 | 9.55 |
| | Phosphoric | 589 | 137 | 1.31 | 7.72 |
| 1400 | Nital | 699 | 249 | 2.14 | 14.96 |
| | Phosphoric | 499 | 102 | 2.71 | 13.52 |
| 1500 | Nital | 647 | 236 | 1.75 | 11.32 |
| | Phosphoric | 390 | 53 | 2.76 | 10.76 |
| 1600 | Nital | 650 | 143 | 0.74 | 4.81 |
| | Phosphoric | Relief up to 250 Å Grooving to 100 Å | | — | — |

*average of 25 or more measurements.
[1]All samples were held for 20 hours at temperature and quenched.

The profilometer shows a rapid increase in height usually within a 2 micron band at the grain boundary once a critical temperature is reached. As aging temperatures are increased, a gradual broadening of the relief zone at the grain boundary takes place with little increase in height. Both light and electron microscopy show that the increase in height occurs primarily during the preprecipitate stage at which point the carbides are too small to resolve by replica transmission electron microscopy; i.e., less than 200 Å in diameter.

EXAMPLE II

An alloy 600 (NiCrFe) having the following composition:

| | |
|---|---|
| C | 0.04 |
| Mn | 0.24 |
| S | 0.007 |
| Si | 0.27 |
| Cr | 15.51 |
| Ni | 75.80 |
| Cu | 0.01 |
| Fe | 8.10 |
| Al | NA |
| Co | 0.03 |
| Ti | NA |

in tube form (½ in. OD×0.062 in. wall) was solution treated at 1925° F. for 5 minutes. Following solution treatment to dissolve the carbides the alloy was water quenched in the manner set forth in Example 1 and samples of this alloy were subjected to the same heat treating procedure of Example 1.

The samples were then cooled to room temperature and evaluated in substantially the same manner as set forth in Example 1. The results of profilometer measurements for these samples is set forth in Table II below.

TABLE II

| Heat Treatment[1] Temperature, °F. Alloy 600 Tubing | Etchant | Height, A* | Std. Dev. Å (Height) | Width, μ* | Nominal Cross Sectional Area, $\mu^2 \times 10^{-1}$ |
|---|---|---|---|---|---|
| 1100 | Nital | 187 | 53 | 0.50 | 0.94 |
| | Phosphoric | 178 | 57 | 0.64 | 1.14 |
| 1200 | Nital | 550 | 142 | 1.11 | 6.11 |
| | Phosphoric | 352 | 122 | 0.76 | 2.68 |
| 1300 | Nital | 599 | 150 | 1.20 | 7.19 |
| | Phosphoric | 519 | 138 | 1.61 | 8.36 |
| 1400 | Nital | 439 | 226 | 1.55 | 6.30 |
| | Phosphoric | 315 | 62 | 2.00 | 6.30 |
| 1500 | Nital | 477 | 209 | 1.36 | 6.49 |
| | Phosphoric | 200 | 43 | 2.83 | 5.66 |
| 1600 | Nital | 634 | 154 | 1.34 | 8.50 |
| | Phosphoric | Relief up to 200Å Grooving to 400Å | | | — |

*average of 25 or more measurements.
[1]All specimens were held for 20 hours at temperature and quenched.

The results set forth in Table II and the electron micrographs of these samples substantially correlate with the results obtained in Example I. The samples show a rapid increase in height at the grain boundary once the critical temperature is obtained and a gradual broadening of the relief zone at the grain boundary with little increase in height as the heat treating temperature increased. At 1600° F. and to a lesser extent 1500° F., the height shown by the nital etch is due solely to massive carbide buildup at the grain boundary and is not a measure of grain boundary relief.

EXAMPLE III

NiCrFe Alloy 625 having the following composition:

| Alloy 625 | |
|---|---|
| C | 0.04 |
| Mn | 0.10 |
| Fe | 3.56 |
| Cr | 21.29 |
| Mo | 8.82 |
| Cb | 3.26 |
| Ti | 0.24 |
| Al | 0.19 |
| S | 0.004 |

was solution treated at 2100° F. for 15 minutes. Following solution treatment to dissolve the carbides, the alloy was cooled by water quench and samples of the alloy are subjected to heat treatment according to the following schedule:

| Temperature, °F./time, hrs | |
|---|---|
| | 1000/20 |
| | 1100/20 |
| | 1200/20 |
| | 1300/20 |
| | 1400/20 |
| | 1500/2 |
| | 1500/20 |

The samples were cooled to room temperature and subjected to evaluation according to the procedures set forth in Example I. The results of the profilometer measurements are set forth in Table III below.

TABLE III

| Heat Treatment Temp, °F./ Time, hrs Alloy 625 Rod | Etchant | Height, Å* | Width, μ* | Nominal Cross Sectional Area $\mu^2 \times 10^{-2}$ |
|---|---|---|---|---|
| 1300/20 | Phosphoric | 1170 | 1.09 | 12.75 |
| 1400/20 | Phosphoric | 1502 | 1.89 | 28.39 |
| 1500/2 | Phosphoric | 1407 | 1.66 | 23.36 |
| 1500/20 | Phosphoric | 1312 | 3.15 | 41.33 |

*Average of 20 or more measurements.

The results of this example substantially corresponded to the results achieved in Examples I and II.

The results of the three examples set forth above, conclusively prove that grain boundary relief consistently results from carbide precipitation. All the tested materials show extensive grain boundary relief.

In all cases grain boundary relief due to carbide formation could be divided conveniently into three stages:

(1) A rapid increase in relief to about the maximum height. Carbides in this stage are submicroscopic (<200 Å).

(2) A growth in width at the grain boundary with little or no increase in height. Carbides are resolvable by replica transmission electron microscopy (>200 Å).

(3) Continued growth in width with a decrease in height until grooving finally occurs except for the measured height of the carbides themselves, which are now resolvable by light microscopy.

It would appear that the optimum relief for both grain boundary delineation and electromicrograph gallery determination for Alloy 600 occurs before a measurable increase in carbide size or a significant increase in grain boundary width takes place. It is particularly significant that since the maximum relief occurs before measurable microscopic carbides are formed, that the grain boundary delineation by the phosphoric acid etch of Alloy 600 at this point is not due to carbide attack but due to the lack of grain boundary attack, which in turn produces the relief effect making the grain boundaries visible.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, Type 304 stainless steel and NiCrFe Alloy 625 have been found to exhibit similar grain boundary relief effects when treated in accordance with the process of the present invention. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A process of fabricating a NiCrFe alloy having a high resistance to stress corrosion cracking comprising:
   (a) heating a finished NiCrFe alloy body to a temperature and for a time sufficient to enable the carbon present in said alloy body in the form of carbide deposits to enter into solution in said alloy body;
   (b) rapidly cooling said alloy body to room temperature avoiding the precipitation of significant amounts of carbides; and
   (c) heating the cooled alloy between the temperature range of about 1100° to 1500° F. for about 10 to 30 hours to maximize the amount of grain boundary relief in said resulting NiCrFe alloy body.

2. The process of claim 1 wherein step (a) comprises heating said finished NiCrFe alloy to a temperature of about 1800 to 2100.

3. The process of claim 1 wherein step (a) further comprises heating said alloy in a nonoxidizing atmosphere.

4. The process of claim 1 wherein step (c) further comprises heating said alloy in a nonoxidizing atmosphere.

5. The process of claim 1 wherein step (c) further comprises heating said alloy in a neutral atmosphere.

6. A process of fabricating a NiCrFe alloy having high resistance to stress corrosion cracking comprising:
   (a) heating a finished NiCrFe alloy body to a temperature sufficient to enable the carbon present in said alloy body in the form of carbide deposits to go into solution in said body;

(b) heating said resulting alloy body at a temperature in the range of about 1100° to 1500° F. for a time of about 10 to 30 hours to maximize the amount of grain boundary relief in said alloy body.

7. The process of claim 6 wherein step (a) comprises heating said finished NiCrFe alloy to a temperature of about 1800 to 2100.

8. The process of claim 6 wherein step (a) further comprises heating said alloy in a nonoxidizing atmosphere.

9. The process of claim 6 wherein step (b) further comprises heating said alloy in a nonoxidizing atmosphere.

10. The method of claim 1 wherein the NiCrFe alloy composition comprises about:

| | | |
|---|---|---|
| C | 0.029 | Wt. % |
| Mn | 0.28 | " |
| S | 0.003 | " |
| Si | 0.27 | " |
| Cr | 14.66 | " |
| Ni | 76.66 | " |
| Cu | 0.01 | " |
| Fe | 7.28 | " |
| Al | 0.18 | " |
| Co | 0.01 | " |
| Ti | 0.21 | " |

11. The method of claim 6 wherein the NiCrFe alloy composition comprises about:

| | | |
|---|---|---|
| C | 0.04 | Wt. % |
| Mn | 0.24 | " |
| S | 0.007 | " |
| Si | 0.27 | " |
| Cr | 15.51 | " |

-continued

| | | |
|---|---|---|
| Ni | 75.80 | " |
| Cu | 0.01 | " |
| Fe | 8.10 | " |
| Al | NA | |
| Co | 0.03 | " |
| Ti | NA | |

12. The method of claim 1 wherein step (c) comprises heating said cooled alloy to about 1200° F. for about 10 to 30 hours.

13. The method of claim 6, wherein step (b) comprises heating said alloy to about 1200° F. for about 10 to 30 hours.

14. A process of fabricating a NiCr Fe alloy having a high resistance to stress corrosion racking comprising:

(a) heating a finished NiCrFe alloy body to a temperature and for a time sufficient to enable the carbon present in said alloy body in the form of carbide deposits to enter into solution in said alloy body;

(b) rapidly cooling said alloy body to room temperature avoiding the precipitation of significant amounts of carbides; and (c) heating the cooled alloy body to about 1500° F. for about 1 to 3 hours to maximize the amount of grain boundary relief in said resulting NiCrFe alloy body.

15. A process of fabricating a NiCrFe alloy having high resistance to stress corrosion cracking comprising:

(a) heating a finished NiCrFe alloy body to a temperature sufficient to enable the carbon present in said alloy body in the form of carbide deposits to go into solution in said body;

(b) heating said resulting alloy body to about 1500° F. for about 1 to 3 hours to maximize the amount of grain boundary relief in said alloy body.

* * * * *